US008085209B2

(12) United States Patent
Llorens del Rio et al.

(10) Patent No.: US 8,085,209 B2
(45) Date of Patent: Dec. 27, 2011

(54) SUB-ARRAY POLARIZATION CONTROL USING ROTATED DUAL POLARIZED RADIATING ELEMENTS

(75) Inventors: Daniel Llorens del Rio, Lausanne (CH); Ferdinando Tiezzi, Renens (CH); Stefano Vaccaro, Gland (CH)

(73) Assignee: ViaSat, Inc., Carlsbad, CA (US)

( * ) Notice: Subject to any disclaimer, the term of this patent is extended or adjusted under 35 U.S.C. 154(b) by 307 days.

(21) Appl. No.: 12/417,513

(22) Filed: Apr. 2, 2009

(65) Prior Publication Data

US 2010/0253585 A1 Oct. 7, 2010

(51) Int. Cl.
*H01Q 19/06* (2006.01)

(52) U.S. Cl. ..... 343/754; 343/756; 343/700 MS

(58) Field of Classification Search ..... 343/700 MS, 343/754, 756, 846, 770; 342/368, 370, 372
See application file for complete search history.

(56) References Cited

U.S. PATENT DOCUMENTS

| | | | | |
|---|---|---|---|---|
| 6,861,983 | B2 * | 3/2005 | Casabona et al. | 342/420 |
| 7,742,000 | B2 * | 6/2010 | Mohamadi | 343/700 MS |
| 7,782,266 | B2 * | 8/2010 | Chang et al. | 343/767 |

FOREIGN PATENT DOCUMENTS

| | | |
|---|---|---|
| EP | 0144867 | 6/1985 |
| EP | 1174946 | 1/2002 |
| JP | 53-039043 | 4/1978 |
| JP | 58-182304 | 10/1983 |
| JP | 3-151703 | 6/1991 |
| JP | 7-321538 | 12/1995 |
| WO | WO 2005/107008 | 11/2005 |
| WO | WO 2006/110026 | 10/2006 |
| WO | WO 2010-002801 | 1/2010 |

OTHER PUBLICATIONS

Extended European Search Report from corresponding European App. No. 10158088.4 dated Jul. 30, 2010.

* cited by examiner

*Primary Examiner* — Hoang V Nguyen
(74) *Attorney, Agent, or Firm* — Snell & Wilmer L.L.P.

(57) ABSTRACT

A system and method of minimizing a polarization quantization error associated with an antenna sub-array. The antenna sub-array includes at least two radiating elements, with the radiating elements having different polarization orientations from other radiating elements in the antenna sub-array. The radiating elements are dual polarized and have electronic polarization control. In an exemplary embodiment, the radiating elements are configured to reduce the polarization quantization error to be less than half of a polarization quantization step size. In various embodiments, rotating the radiating elements and implementing a phase delay, individually or in combination, is used to change the polarizations of the radiating elements.

21 Claims, 19 Drawing Sheets

SUB-ARRAY POLARIZATION CONTROL USING ROTATED DUAL POLARIZED RADIATING ELEMENTS

FIELD OF INVENTION

The present invention relates to polarization control in an antenna sub-array. More particularly, the invention relates to dual polarized radiating elements with electronic polarization control configured to reduce polarization quantization error.

BACKGROUND OF THE INVENTION

Low profile antennas for communication on the move (COTM) are used in numerous commercial and military applications, such as automobiles, trains and airplanes. Mobile terminals typically require the use of automatic tracking antennas that are able to steer the beam in azimuth, elevation and polarization to follow the satellite position while the vehicle is in motion. Moreover, the antenna should be "low-profile", small and lightweight, thereby fulfilling the stringent aerodynamic and mass constraints encountered in the typical mounting of antennas in airborne and automotive environments. The invention addresses this and other needs.

The capability to steer the polarization of the beam is necessary when the antenna receives a linear polarized signal and the antenna platform is mobile. Previously, the accuracy of polarization tracking in digitally controlled phased arrays was solely determined by the accuracy of the polarization phase shifters, determined by the number of bits in the phase shifter. Other approaches to steering the polarization have been directed towards controlling the quantization lobes in an attempt to manage the quantization of the polarization steering control. However, quantization lobes are just a secondary effect of the quantization. Moreover, this approach does not overcome the fundamental limitation imposed by the polarization phase shifters on the accuracy of polarization tracking. Thus, a need exists for an approach to improve polarization tracking control using a predetermined number of bits in a polarization phase shifter.

SUMMARY OF THE INVENTION

A system and method of minimizing a polarization quantization error associated with an antenna sub-array is disclosed herein. The antenna sub-array includes at least two radiating elements, with the radiating elements having different polarization orientations from other radiating elements in the antenna sub-array. The radiating elements are dual polarized and have electronic polarization control. In an exemplary embodiment, the radiating elements are configured to reduce the polarization quantization error to be less than half of a polarization quantization step size. In various embodiments, rotating the radiating elements and implementing a phase delay, individually or in combination, are used to change the polarizations of the radiating elements.

Furthermore, a logical group of radiating elements may be configured to reduce the polarization quantization error of an antenna sub-array to be less than half of a polarization quantization step size. The logical group may comprise 3-9 radiating elements. In one embodiment, one logical group is rotated relative to a second logical group. In an exemplary embodiment, the radiating elements in the logical group are evenly distributed about a common point, such that the radiating elements are substantially equally spaced.

BRIEF DESCRIPTION OF THE DRAWING FIGURES

A more complete understanding of the present invention may be derived by referring to the detailed description and claims when considered in connection with the drawing figures, wherein like reference numbers refer to similar elements throughout the drawing figures, and:

DETAILED DESCRIPTION

While exemplary embodiments are described herein in sufficient detail to enable those skilled in the art to practice the invention, it should be understood that other embodiments may be realized and that logical electrical and mechanical changes may be made without departing from the spirit and scope of the invention. Thus, the following detailed description is presented for purposes of illustration only.

In accordance with an exemplary embodiment of the present invention, an antenna comprises an antenna array. The antenna array may further comprise one or more antenna sub-arrays. The antenna sub-array in turn may comprise a plurality of radiating elements. In further exemplary embodiments, the plurality of radiating elements may individually comprise a 'combined' phase shifter. Moreover, the antenna may further comprise a feed-network that is connected to the combined phase shifter of each radiating element.

Antenna Array

Figure 1:
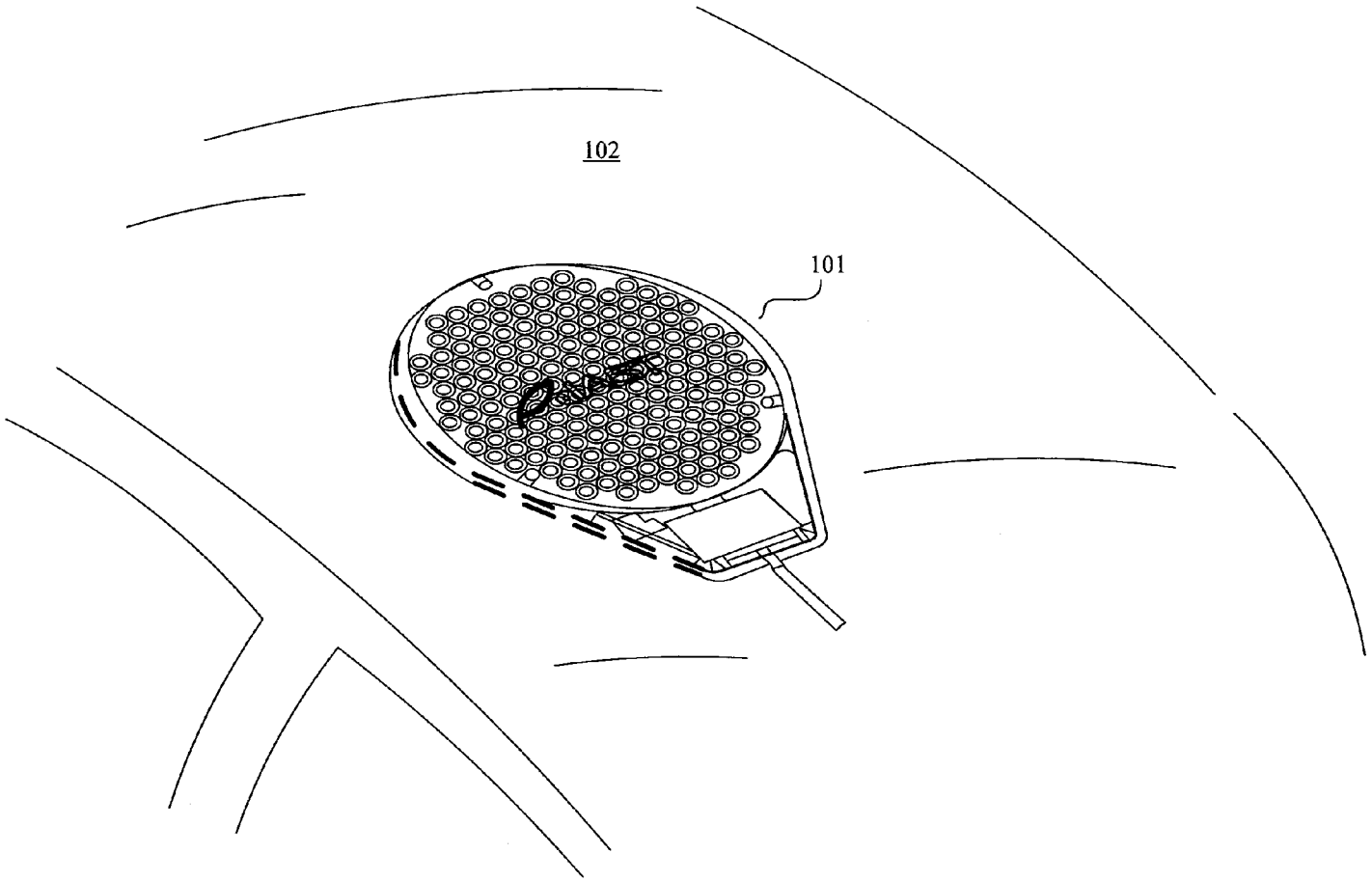
FIG. 1 shows an illustration of an exemplary mobile antenna.

In an exemplary embodiment, and with reference to FIG. 1, an antenna 101 is designed for use with a mobile platform 102 on an automobile, airplane, boat, or any other moving object. For example, the antenna may be mounted to the roof of a car. The antenna may be configured to have a low profile. Moreover, the antenna may be configured to employ polarization tracking and beam steering. In another exemplary embodiment, the antenna array has an overall diameter of 20 cm or less, but the antenna may have any suitable diameter. In further exemplary embodiments, the antenna is configured to facilitate transmitting and receiving radio frequency ("RF") signals from a satellite. In an exemplary embodiment the antenna is configured to not have any moving parts. The antenna may further be configured to receive and transmit RF signals with a reduced quantization error. In addition, the antenna may employ phase delay and a fully electronic steering system with improved polarization tracking performances.

Sub-Array

As stated above, in accordance with an exemplary embodiment, the antenna array may comprise a plurality of sub-arrays. A sub-array may comprise any assembly of more than one radiating element. In an exemplary embodiment, a linear sub-array comprises a 'brick' of radiating elements arranged side by side in a line. For example, five radiating elements might be assembled on a linear sub-array. Of course any suitable number of elements may be used to form a sub-array. Furthermore, the sub-array may comprise any suitable layout of radiating elements, such as a circular or rectangular layout, and is not limited to just linear sub-arrays.

In an exemplary embodiment, the sub-arrays may be any size suitable for holding the radiating elements. Moreover, in accordance with an exemplary embodiment, a sub-array is modular in nature. Two or more sub-arrays may be combined to form the desired dimensions and operating parameters of an antenna array.

In a prior art linear sub-array, the radiating elements have the same physical polarization orientation. In other words, the slots in the ground plane of each radiating element are positioned with the same orientation as other radiating elements within the sub-array. Moreover, in a typical linear sub-array, each radiating element of the sub-array is controlled together with other radiating elements of the sub-array.

In accordance with an exemplary embodiment, however, the polarization orientation of at least one of the radiating elements of the sub-array is different from the polarization orientation of another of the radiating elements of the sub-array. Moreover, in accordance with an exemplary embodiment, the polarization orientation of each radiating element in a sub-array may be controlled independently of the other radiating elements.

Radiating Element

Figure 2:
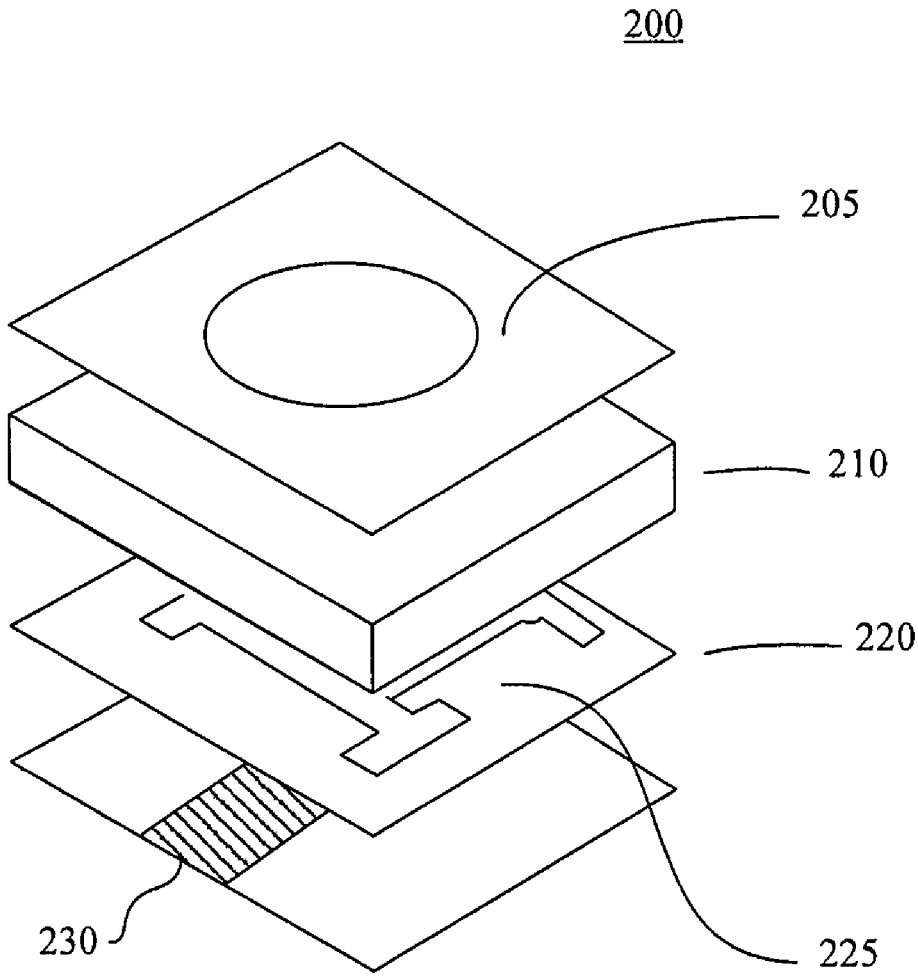
FIG. 2 shows an illustration of an exemplary radiating element.

In an exemplary embodiment, and with reference to FIG. 2, a radiating element 200 comprises a patch 205, a substrate 210, a ground plane 220, and a feed line 230. In an exemplary embodiment, radiating element 200 is unidirectional and radiates efficiently in only one direction. In a further exemplary embodiment, radiating element 200 is a dual polarized radiating element with a ground plane 220, which comprises orthogonal slots 225. For illustration purposes, the dual polarization of the radiating element will be limited to horizontal and vertical polarizations.

Figure 3:
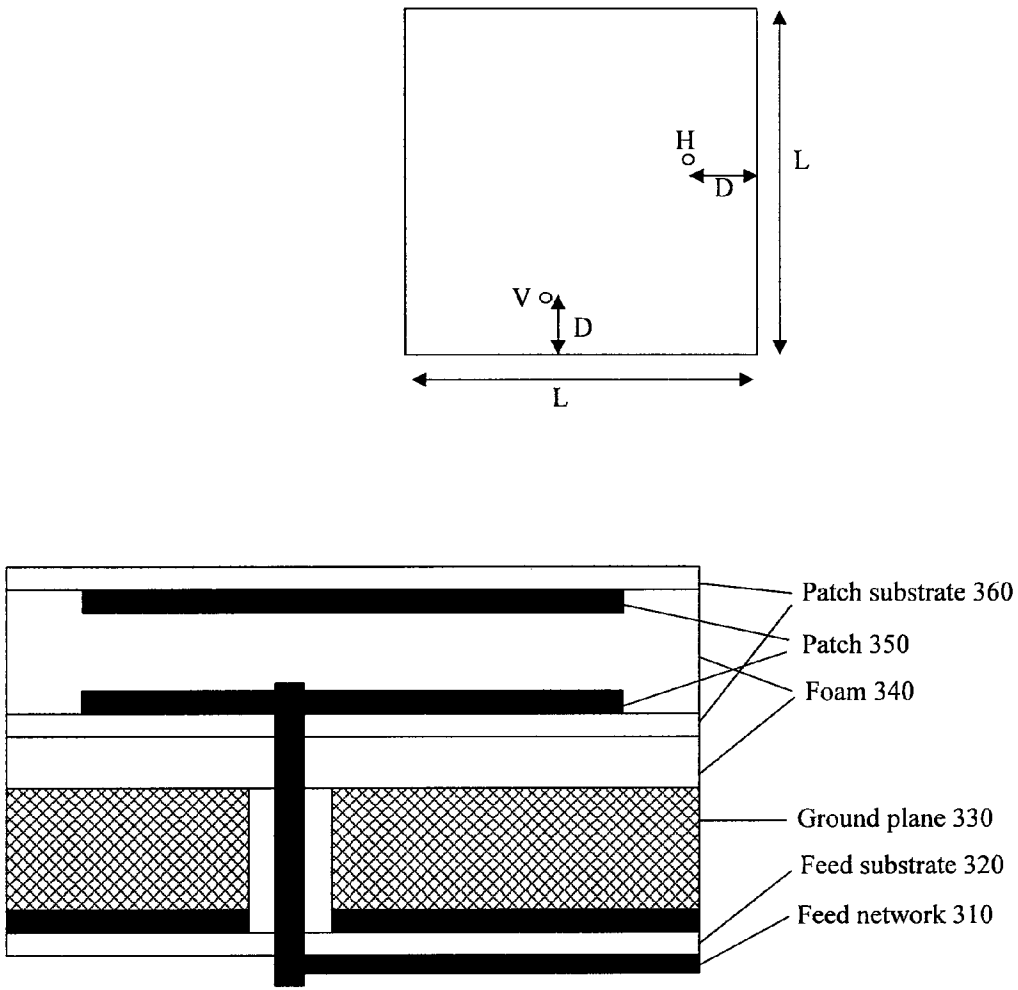
FIG. 3 shows another example of an exemplary radiating element.

Radiating element 200 can be configured in different suitable embodiments. For example, in one exemplary embodiment and with reference to FIG. 3, radiating element 200 may comprise a feed network 310, a feed substrate 320, a ground plane 330, at least one foam section 340, at least one patch substrate 360, and at least one patch 350. In a second exemplary embodiment, radiating element 200 comprises two foam sections and two patch substrates. Although exemplary structures are described herein for the radiating element 200, it should be understood that many different structures may be used consistent with that which is disclosed herein. Therefore, those radiating element structures that are well known in the art will not be described in detail.

In accordance with an exemplary embodiment, radiating element 200 comprises a single substrate 210 for a phased array antenna with polarization control. The exemplary embodiment antenna has electrical components on one side of the substrate and a radiating element on the other side.

Furthermore, in an exemplary embodiment, radiating element 200 is configured to receive signals in the Ku-band, which is approximately 10.7-14.5 GHz. In another embodiment, radiating element 200 is configured to receive signals in the Ka-band, which is approximately 18.5-30 GHz. In yet another embodiment, radiating element 200 is configured to receive signals in the Q band, which is approximately 36-46 GHz. In other exemplary embodiments, radiating elements may be configured to receive any suitable frequency band. Additionally, in an exemplary embodiment, radiating element is part of an antenna configured to scan at least 20° above horizon to the zenith.

Furthermore, though the radiating elements and antenna system described herein is referenced in terms of receiving a signal, the antenna system is not so limited. Accordingly, in an exemplary embodiment, the radiating elements may be configured to transmit a signal at various frequencies, similar to the receiving of signals. Additionally, the systems and methods described herein may be applicable to non-linear polarized signals.

Various characteristics of radiating element 200 are used to define the operation of an antenna, including beam steering and polarization orientation. Physical polarization orientation is defined by the physical shape and layout of orthogonal slots 225 in ground plane 220 of radiating element 200. For example, orthogonal slots 225 are configured to separate the received linear polarized signal into horizontal and vertical polarizations. In addition to a physical polarization orientation, radiating element 200 is configured to have multiple polarization states by implementing electronic polarization control.

Polarization

A number of broadcast satellites emit dual orthogonal linearly polarized signals (termed 'H' and 'V') in overlapping channels. For a mobile receiver, these polarizations may appear at arbitrary orientations. In accordance with an exemplary embodiment, the antenna is configured to reorient the polarization of the antenna electronically. The accuracy of this alignment has a direct impact on adjacent channel interference (and consequently on the signal to noise ("S/N") ratio) and also a minor impact on gain (and consequently on S/N ratio).

In accordance with an exemplary embodiment, a phase shifter is configured to control the electronic polarization states of radiating element 200. In an exemplary embodiment, each radiating element 200 is associated with at least one individual phase shifter. In another exemplary embodiment, each radiating element 200 is associated with as many phase shifters as required by the particular polarization control implementation. Thus, in this exemplary embodiment, the antenna is configured to independently control the polarization states of each radiating element 200. Therefore, even if each radiating element is physically constructed in an array such that the slots have a common orientation, the polarization orientation of each radiating element 200 may be different from that of other radiating elements in the array due to electronic polarization control.

In an exemplary embodiment, the phase shifter is a generally a digital phase shifter capable of a discrete set of phase states. The number of phase states in a phase shifter is a function of the number of bits in the phase shifter. The higher the number of bits in the phase shifter, the more phase states are possible and this results in more accurate shifting for matching the quantized digital value to the analog value of the received signal. A benefit of accurate shifting is a smaller difference between the actual analog value of the polarization and quantized digital value, known as the polarization quantization error. In an exemplary embodiment of the present invention, the novel techniques described herein facilitate reduction of the polarization quantization error when compared to an antenna of similar type that does not use the novel techniques described herein.

Figure 4:
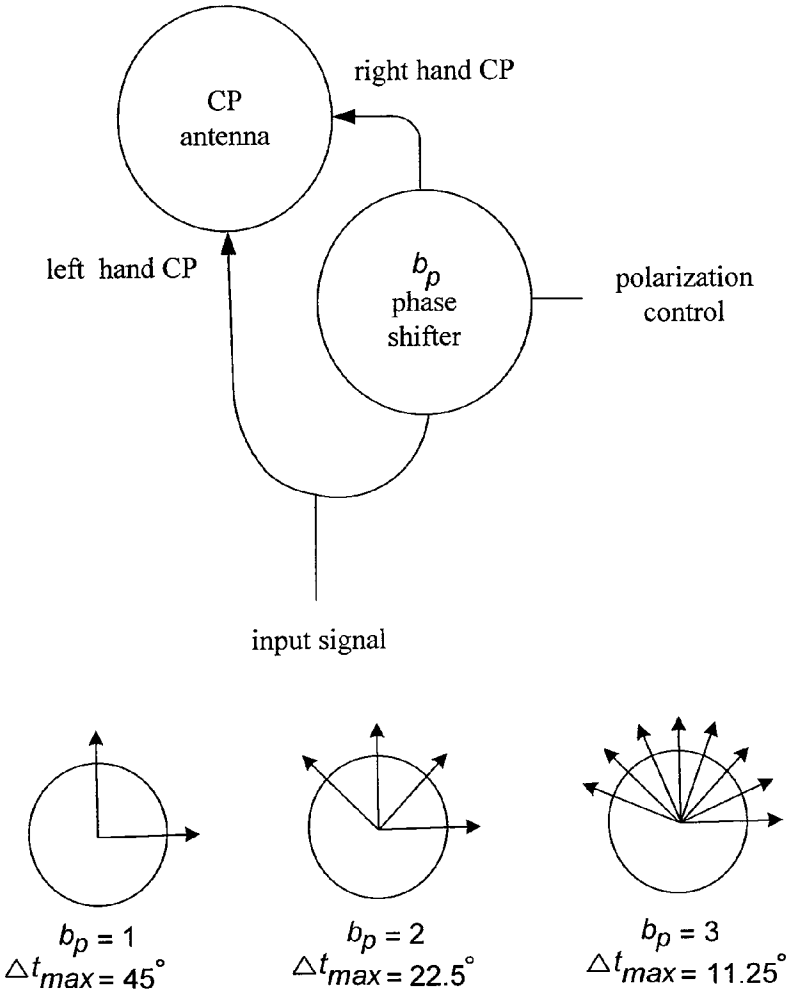
FIG. 4 shows an exemplary polarization control group and available polarization states.

Only a half-circle is used to describe the polarization states because the polarization states that are separated by 180 degrees ($\pi$) are equivalent. In other words, the polarization state at angle $\theta$ is equivalent to the polarization state at angle $\theta+180$. With reference to FIG. 4, a one bit phase shifter (b=1) (herein referred as b or as $b_p$) has only two available polarization states ($2^b$), with an angular separation of 45 degrees ($\pi/2^b$). A phase shifter with two bits has four available polarization states with an angular separation of 22.5 degrees. A phase shifter with three bits has eight available polarization states with an angular separation of 11.25 degrees. An increase in available polarization states decreases the worst possible tracking error. In accordance with an exemplary embodiment, the worst possible tracking error is half the angular separation ($\pi/2^{b+1}$).

Figure 5A:
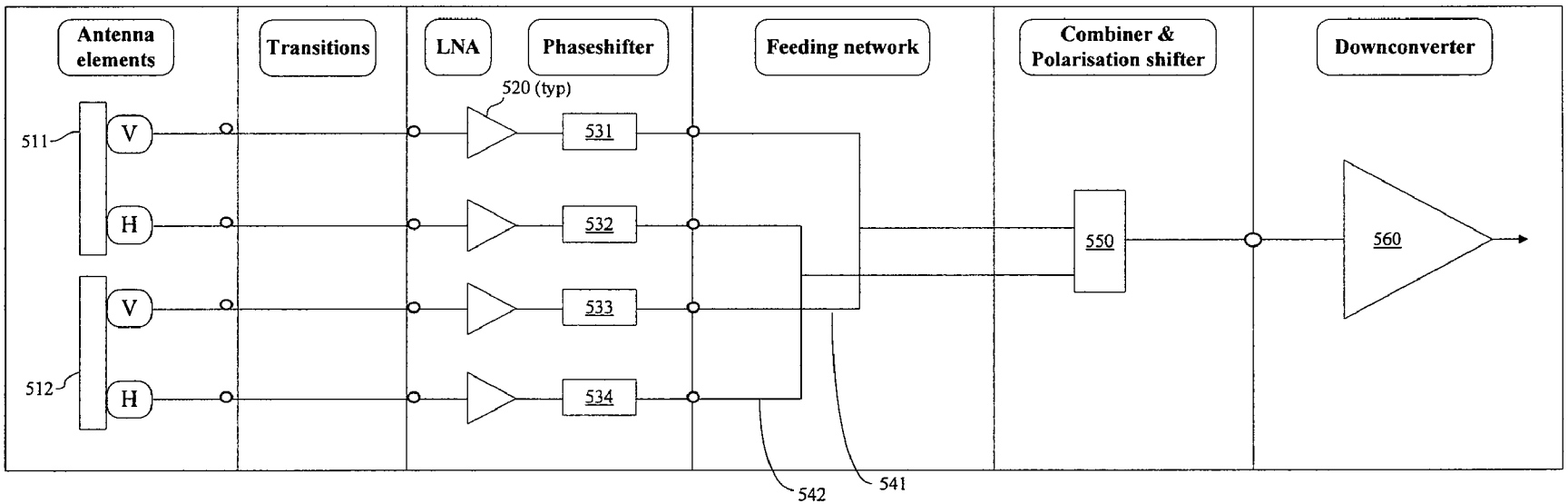
Prior Art Figure 5A
FIG. 5A shows a block diagram of a prior art antenna array system.

FIG. 5A illustrates a typical phase array circuit in a receive antenna, the typical phase array circuit comprising a first radiating element 511 and a second radiating element 512, low noise amplifiers 520, phase shifters 531-534, a first feeding network 541, a second feeding network 542, a combiner and polarization shifter 550, and a downconverter 560. Radiating elements 511 and 512 are dual polarized radiating elements and each represent, respectively, a vertical polarization (V) and a horizontal polarization (H).

Each polarized signal is communicated from the antenna element (e.g., 511 and 512) through a low noise amplifiers (520 typ.) to respective phase shifters. For example, the vertical polarized signal of first radiating element 511 is communicated through an LNA to phase shifter 531 and the vertical polarized signal of second radiating element 512 is communicated through another LNA to phase shifter 533. The output of phase shifters 531 and 533 are combined in first feeding network 541. Similarly, the horizontal polarized signal of first radiating element 511 is communicated through phase shifter 532 and combined in second feeding network 542 with the horizontal polarized signal from second radiating element 512 that is communicated through phase shifter 534.

The combined vertical and horizontal polarized signals are then communicated by first and second feeding network 541 and 542 to combiner and polarization shifter 550. Combiner and polarization shifter 550 performs polarization control on the polarized signals, combines them into a single signal and communicates that single signal to downconverter 560.

Figure 5B:
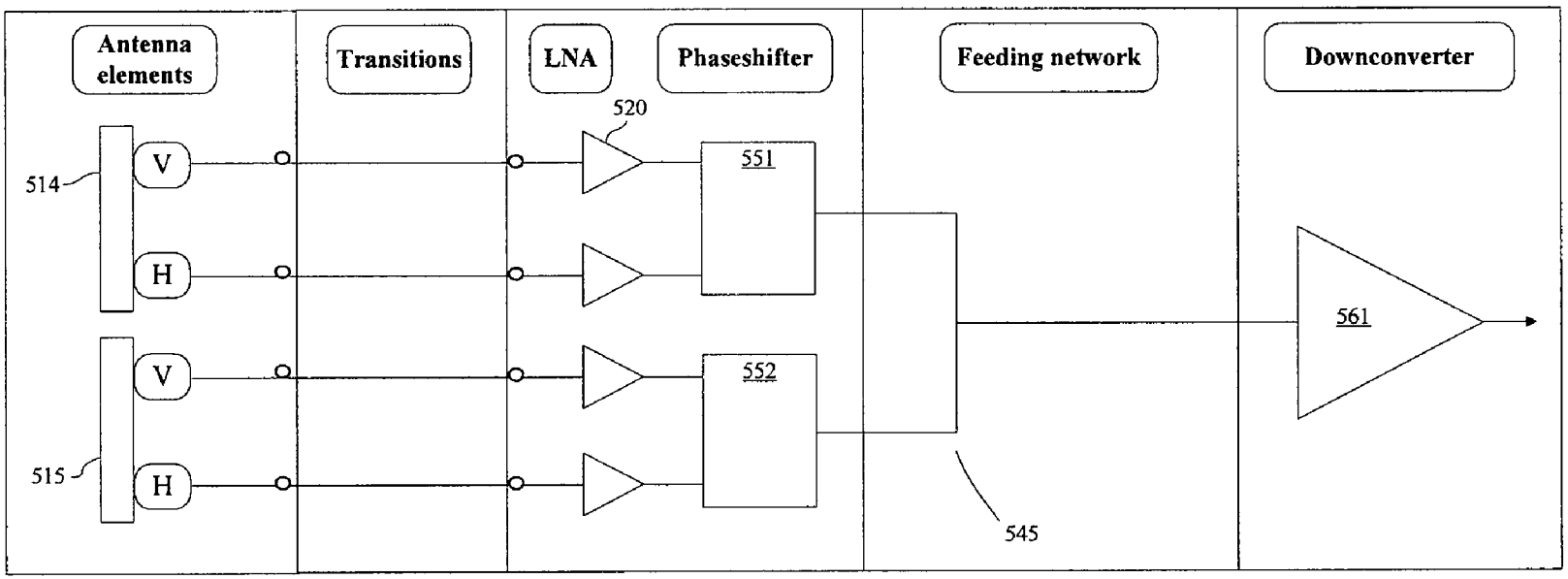
FIG. 5B shows a block diagram of another exemplary antenna array system.

In contrast, and with reference to FIG. 5B, in accordance with an exemplary embodiment, a combined phase shifter (e.g. 551 and 552) may be used. In a receive antenna, combined phase shifter 551, 552 receives dual polarized signals from a single radiating element 514, 515 and combines the dual polarized signals into a complete signal. In addition to a receive antenna, similar phased array circuits and concepts are applicable to a transmit antenna, and a transmit/receive antenna.

Figure 5C:
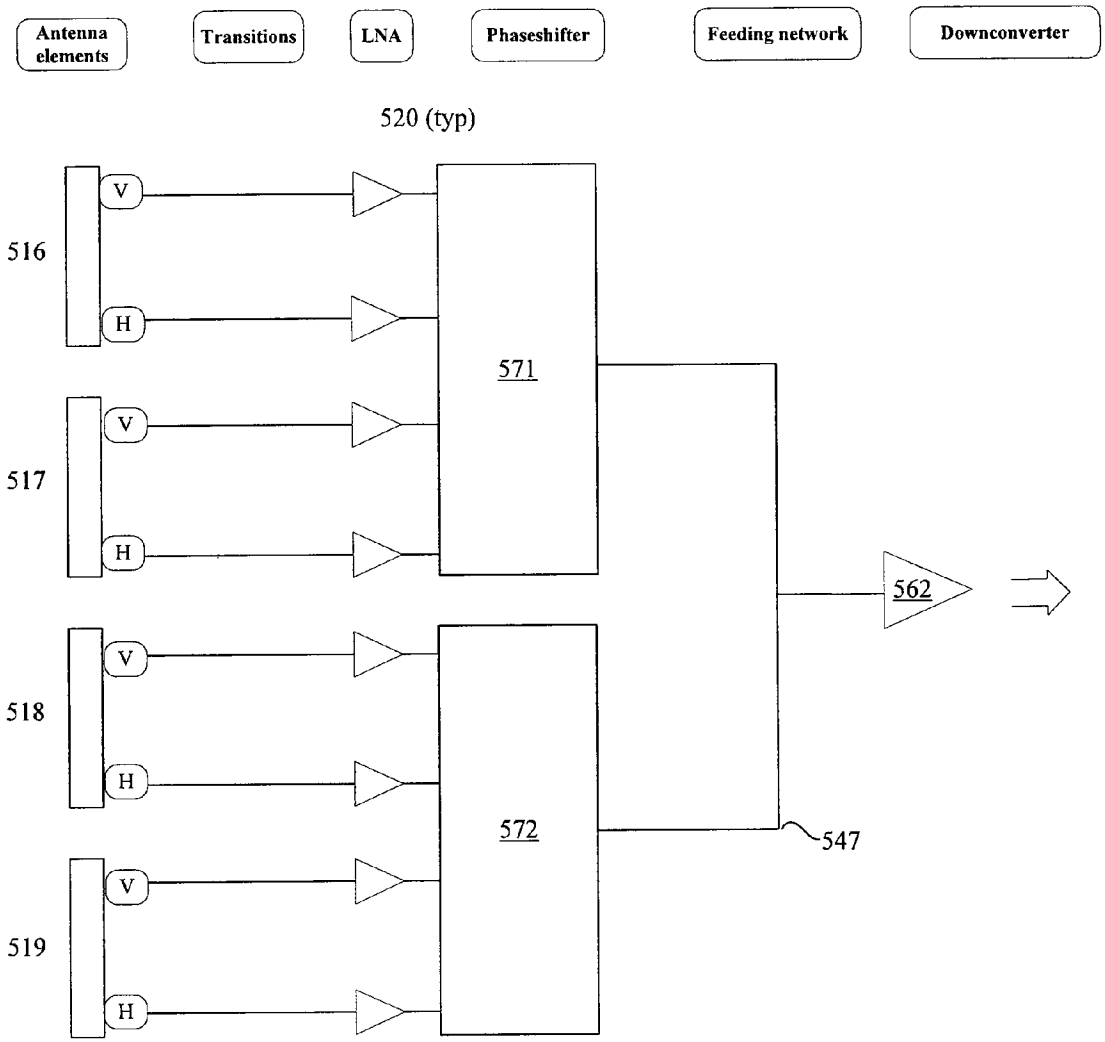
FIG. 5C shows a block diagram of another exemplary antenna array system.

Furthermore, in an exemplary embodiment of a receive antenna circuit and with momentary reference to FIG. 5B, each radiating element is in communication with a single combined phase shifter. In other embodiment, a single phase shifter is associated with two or more radiating elements 200. In another exemplary embodiment and with reference to FIG. 5C, a first radiating element 516 and a second radiating element 517 both transmit dual polarized signals to a first combined phase shifter 571. Furthermore, a third radiating element 518 and a fourth radiating element 519 both transmit dual polarized signals to a second combined phase shifter 572. The output of combined phase shifters 571, 572 are combined in a single feeding network 547, and communicated to a downconverter 562.

In this exemplary embodiment, each set of the two or more radiating elements 200 (e.g., each pair of radiating elements) are configured to have orientated polarization states independent of other pairs of radiating elements 200 in the antenna sub-array. It should be understood that the various methods and techniques (e.g., rotation and/or phase delay relative to another radiating element(s)) of polarization error control disclosed herewith are equally applicable to the embodiments where two or more radiating elements share the same phase shifter, namely. The two or more radiating elements 200 that share a phase shifter will have the same polarization states, in contrast to each radiating element being capable of independent polarization states.

Figure 6:
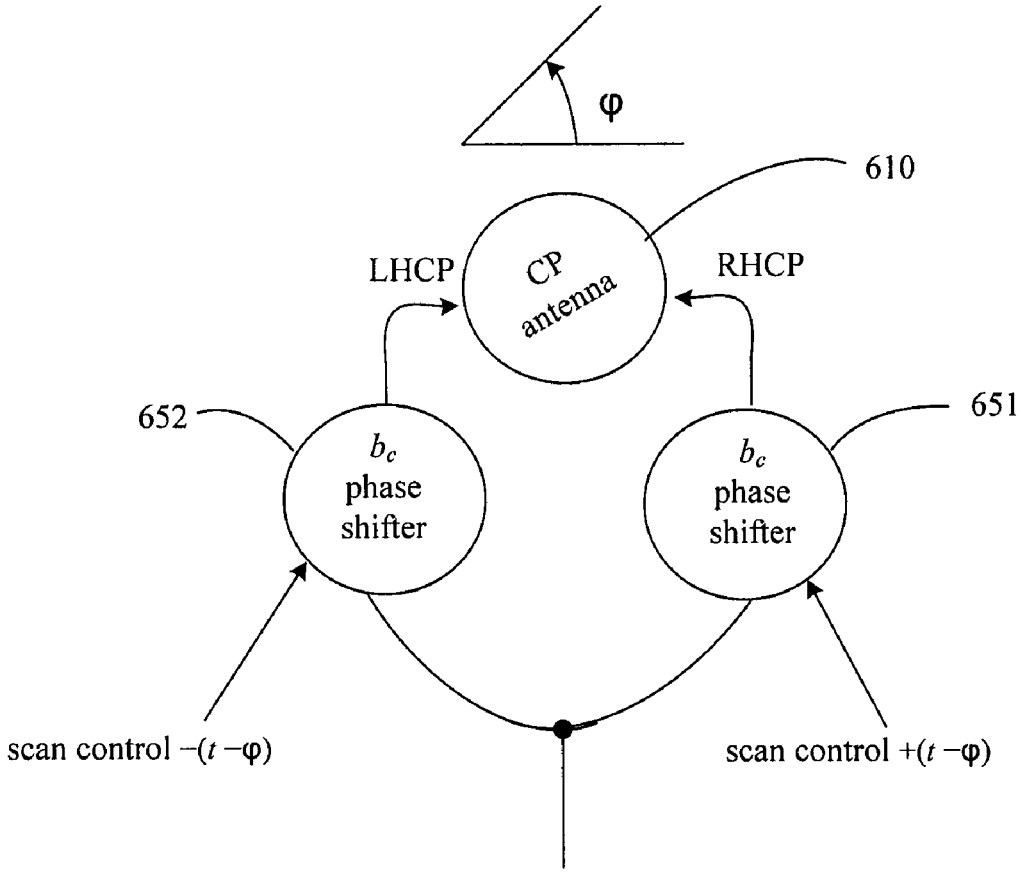
FIG. 6 shows an exemplary control circuit for a radiating element.

In accordance with one exemplary embodiment, and with momentary reference to FIG. 6, a balanced phase shifter approach may be used with combined phase shifters 651, 652 in communication with an antenna 610. The balanced design of phase shifters may comprise two phase shifters per radiating element, one phase shifter for the vertical signal and the other phase shifter for the horizontal signal. In this embodiment, the polarization and scanning signals can be quantized together and combined into a single phase shifter of each polarization signal instead of each phase shifter being dedicated for a single task. In a balanced arrangement, only one phase shifter worth of insertion loss is injected because the phase shifter is shared for beam steering and polarization control.

Figure 7:
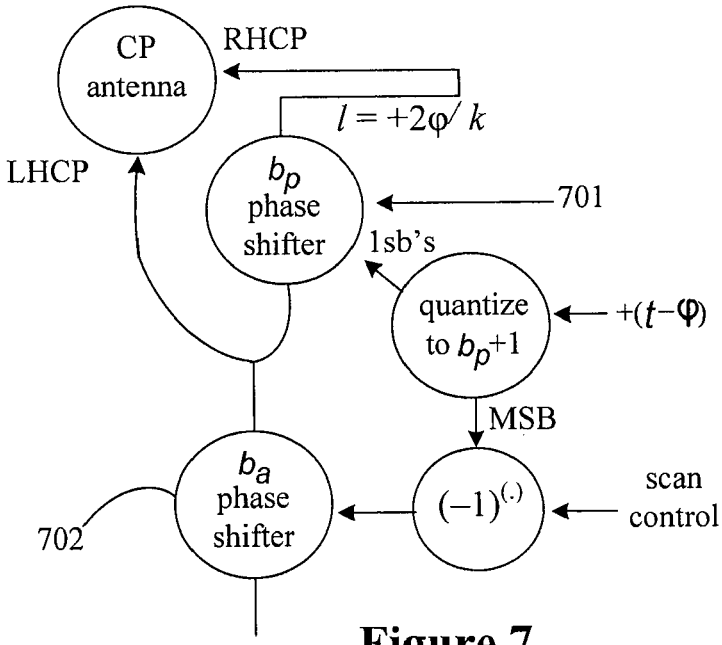
FIG. 7 shows an exemplary control circuit for a phase delayed radiating element.
Figure 8:
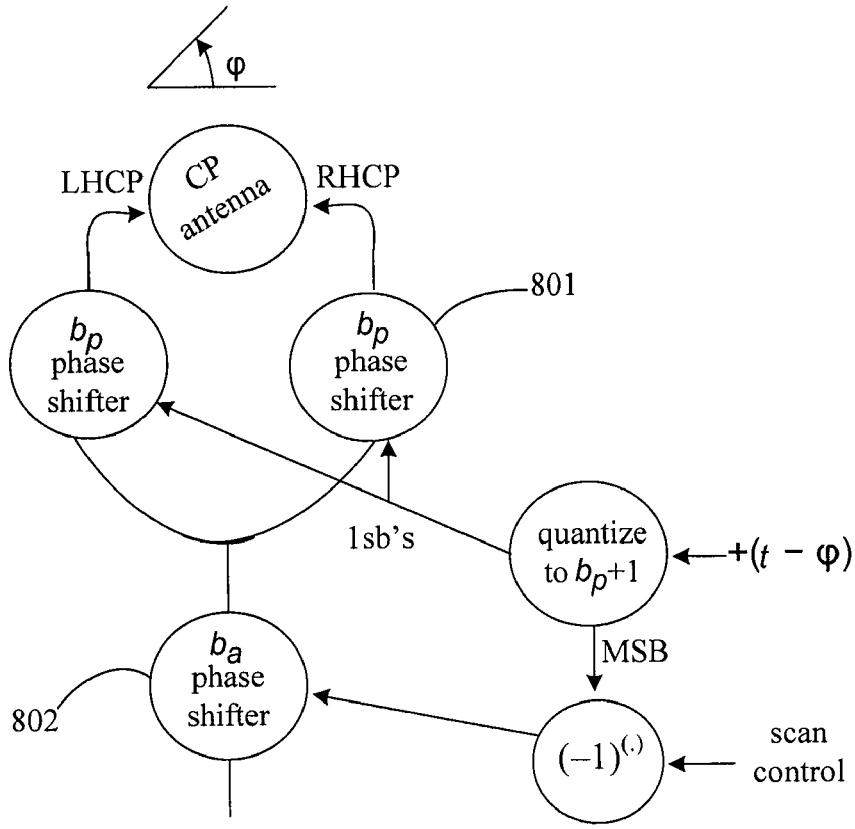
FIG. 8 shows an exemplary control circuit for a rotated radiating element.

In contrast and in other exemplary embodiments, with momentary reference to FIGS. 7 and 8, the phase shifters have a dedicated function with regards to beam steering and polarization control. In other words, a phase shifter with a dedicated function performs either beam steering or polarization control. A common beam steering phase shifter $b_s$ 702, 802 applies to both signal polarizations as shown in both FIGS. 7 and 8. In an unbalanced design, as illustrated in FIG. 7, only one polarized signal out of two polarized signals is altered by a polarization phase shifter $b_p$ 701. A balanced design is illustrated in FIG. 8, where each polarization signal is altered differently than the other polarization signal by a polarization phase shifter $b_p$ 801.

In an exemplary embodiment, radiating element 200 has independent polarization states because the polarizations are configured to be combined at the element level, instead of at the network level. FIG. 5B illustrates an exemplary receive antenna circuit for the balanced phase shifter approach using a combined phase shifter. The phased array circuit comprises a first radiating element 514 and a second radiating element 515, low noise amplifiers 520, combined phase shifters 551 and 552, a single feeding network 545, and a downconverter 561. Radiating elements 514 and 515 are dual polarized and each comprise a vertical polarization (V) component and a horizontal polarization (H) component. The signal representing each polarization is transmitted through low noise amplifiers (520 typ.). In the exemplary circuit, combined phase shifters 551 and 552 each receive both dual polarized signals from radiating elements 514 and 515, respectively. In an exemplary embodiment, each of combined phase shifters 551 and 552 are configured to perform polarization control, beam steering, or both. Once the receive antenna circuit has performed both functions, signals received from multiple radiating elements 514 and 515 may be combined in feeding network 545 and communicated to downconverter 561. Feeding network 545 communicates the entire received signal, whereas in the prior art circuit (see FIG. 5A) there are two feeding networks, each communicating a separate polarized signal. In a balanced phase shifter approach with a combined phase shifter ($b_c$) (see FIG. 6), only one phase shifter worth of insertion loss is injected in the circuit because the phase shifter may be configured to perform dual functions of polarization control and beam steering. In addition, and in contrast with the unbalanced approach illustrated by FIG. 7, the insertion loss is the same in both branches of the combined phase shifter circuit. The unbalanced approach produces a degradation of the crosspolarization for all polarization states and generally needs compensation in the form of an attenuator. Thus, a balanced circuit with combined phase shifters is configured to reduce the insertion loss to half the insertion loss of either the unbalanced approach (described with reference to the phase shifters of FIG. 7) or the balanced approach with dedicated-purpose phase shifters, such as the phase shifters described with reference to FIG. 8.

Figure 9:
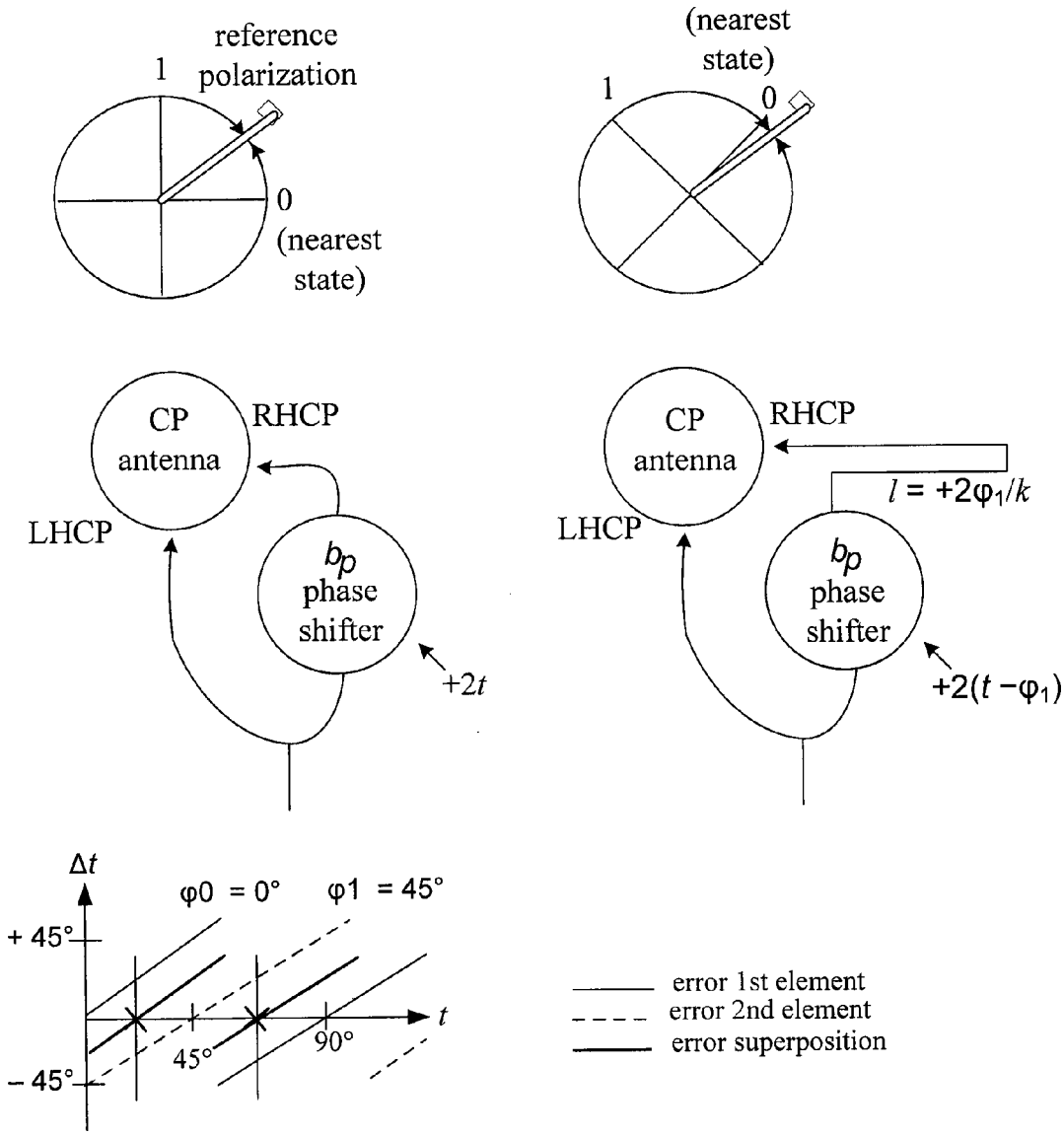
FIG. 9 shows an exemplary embodiment of a phase delayed radiating element and graphical representation of the resulting tracking error.

In an exemplary embodiment, and with a reference to FIG. 9, a phase delay is introduced between the horizontal and vertical polarization inputs of the array antenna. In an exemplary embodiment, a phase delay may be introduced by a phase shifter, a change in length of line feed, or a combination thereof. The dual polarization inputs of the array antenna are combined in the antenna system, with the phase delay value controlling the electronic polarization state of the radiating element.

In accordance with a further exemplary embodiment, a radiating element may be configured to implement a phase delay in order to provide slightly different polarization states. The polarization states of various radiating elements are combined and result in reduced tracking errors. The graphical representation of FIG. 9 shows the reduced tracking errors resulting from implementing phase delays. In an exemplary embodiment, the use of phase delay is combined with the use of rotation of radiating elements for increased polarization control. In an exemplary embodiment, the polarization states of at least two radiating elements are complementary, and thus result in the reduced tracking errors when combined. In an exemplary embodiment, complementary radiating elements are equally distributed around a polarization circle and thus optimally arranged to minimize the worst case polarization quantization error. The polarization states may be complementary due to application of a phase delay, rotation of a radiating element, or a combination of both. Moreover, in an exemplary embodiment, complementary polarization states are polarization states having polarization quantization errors of different signs.

Figure 10B:
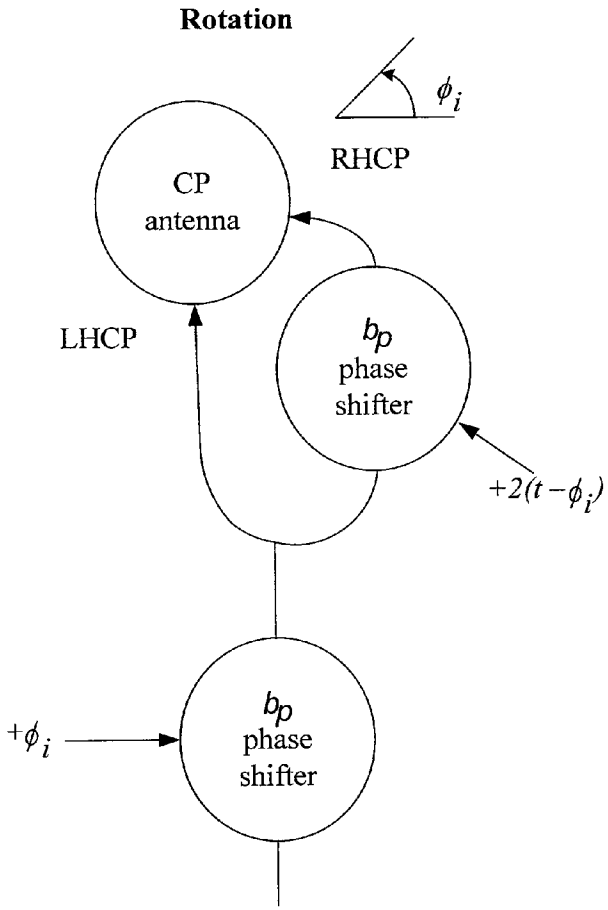
FIGS. 10A, 10B show an exemplary embodiment implementing phase delay and an exemplary embodiment implementing rotation.
Figure 10A:
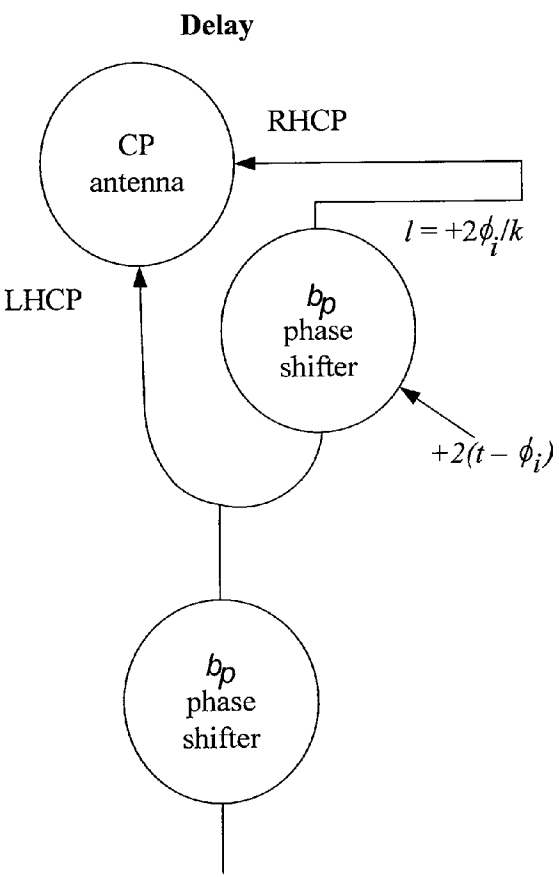

In an exemplary embodiment, polarization control is accomplished using phase delays, rotation of the radiating elements, or by a combination of phase delays and rotation. FIGS. 10A, 10B illustrate these two principles, with a phase delayed control circuit on the left and a rotation control circuit on the right. In an exemplary embodiment, the phase shifters in either circuit are configured for is slightly different purposes. For example, in the phase delayed control circuit, the RHCP branch is phase-delayed by $2*\phi i$. Therefore, the polarization phase shifter only acts on that branch. In contrast, in the rotation control circuit, both the RHCP (by $+\phi i$) and the LHCP (by $-\phi i$) are phase delayed. Therefore the polarization phase shift is applied on both branches by acting both on the polarization phase shifter and on the scanning phase shifter, which has a dual ('combined') role.

Figure 11:
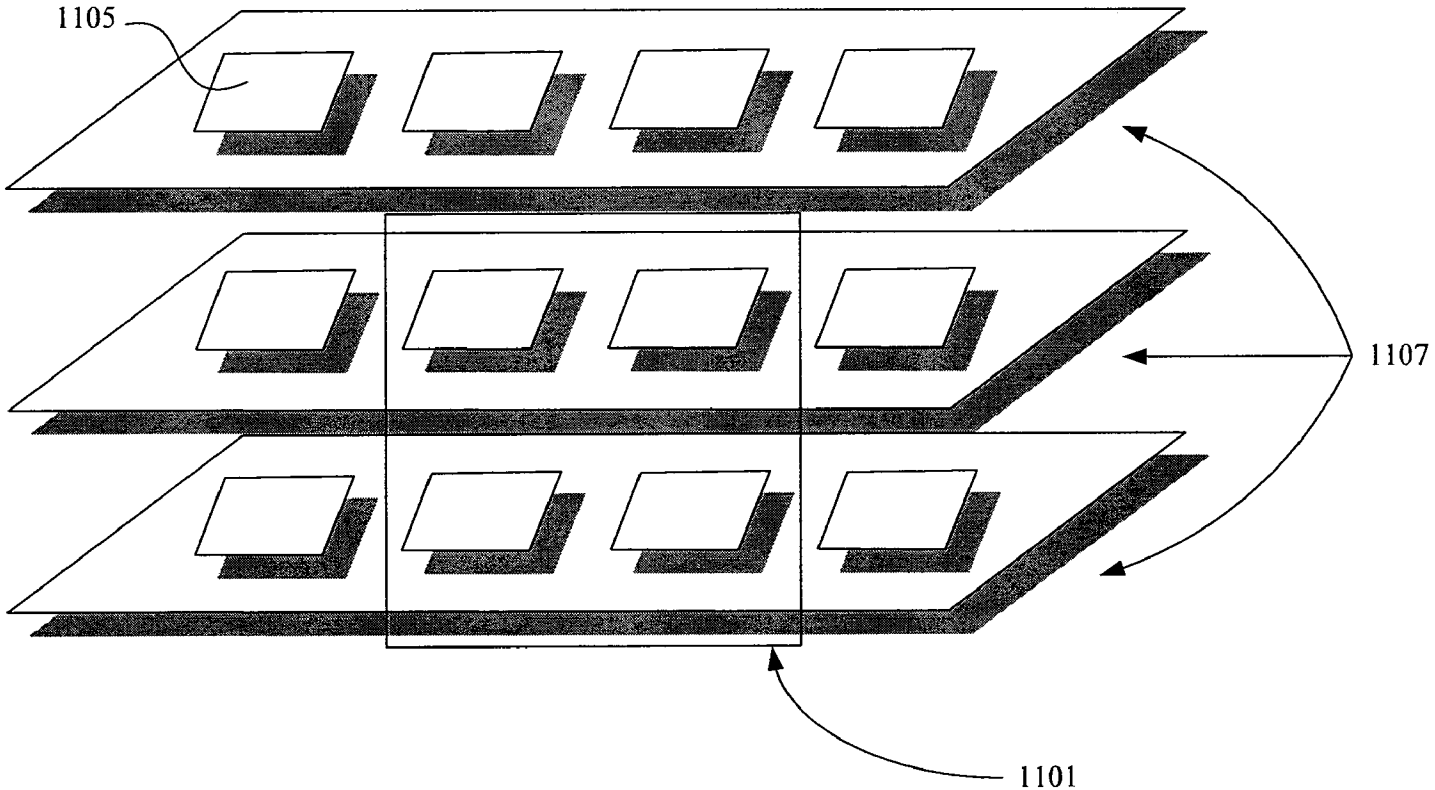
FIG. 11 shows an illustration of a logical group of radiating elements across multiple sub-arrays.

When describing radiating elements as different from at least one other radiating element, it is useful to refer to a group of radiating elements. As illustrated by FIG. 11, a group 1101 is a logical grouping of radiating elements and helps to define the configuration of the radiating elements within a group relative to each other, but also the configuration of the radiating elements in comparison to another group. In contrast, a sub-array 1107 is the physical grouping radiating elements on the same module or printed circuit board. A group is two or more radiating elements, and in various embodiments may be three, four, five, or more radiating elements. For example, each polarization control group may be configured to contain M radiating elements. A polarization control group may have as few as two radiating elements or as large a number of elements as exist in the whole array.

In a number of exemplary embodiments, the number of elements in a polarization control group is an odd number from 3-9. Odd numbers tend to avoid redundant orientations. Furthermore, the larger the number of elements in a polarization control group, the larger the area covered by the control group and the more likely the elements will be too far apart from each other to realize the beneficial results of the differential polarization within the control group. Therefore, in exemplary embodiments, the number of elements in a control group is three or five.

In an exemplary embodiment, the radiating elements in a polarization control group are arranged in a circle and evenly spaced within the circle. However, such an arrangement applies to a group with an odd number of elements. This is because an even number of radiating elements has initial polarization orientations that coincide with the polarization states of the remaining radiating elements. The rotations will not modify the polarization quantization error. For example, a 4-element polarization control group may comprise elements rotated at 0°, 90°, 180° and 270° for a symmetrical arrangement. These rotations can be exactly produced by a 1-bit digital phase shifter and will not reduce the polarization quantization error because of a lack of compensation between complementary states. However, in an exemplary embodiment, with a 4-element polarization group, polarization control can still be produced with differential phase delays in the length of the feed lines to the radiating elements.

In contrast to a 4-element group, in another example, a 3-element polarization control group may comprise elements rotated at 0°, 120°, and 240° for a symmetrical arrangement. In an exemplary embodiment, each radiating element is in communication with a 1-bit digital phase shifter. The first radiating element has polarization states of 0°, 90°, 180°, and 270°. The second radiating element has polarization states of 120°, 210°, 300°, and 30°. The third radiating element has polarization states of 240°, 330°, 60°, and 150°. Accordingly, the polarization states of the radiating elements are all different and equally divide the circle. In accordance with the exemplary embodiment, the worst-case polarization quantization error for the group is reduced by a factor of 3.

Figure 12A:
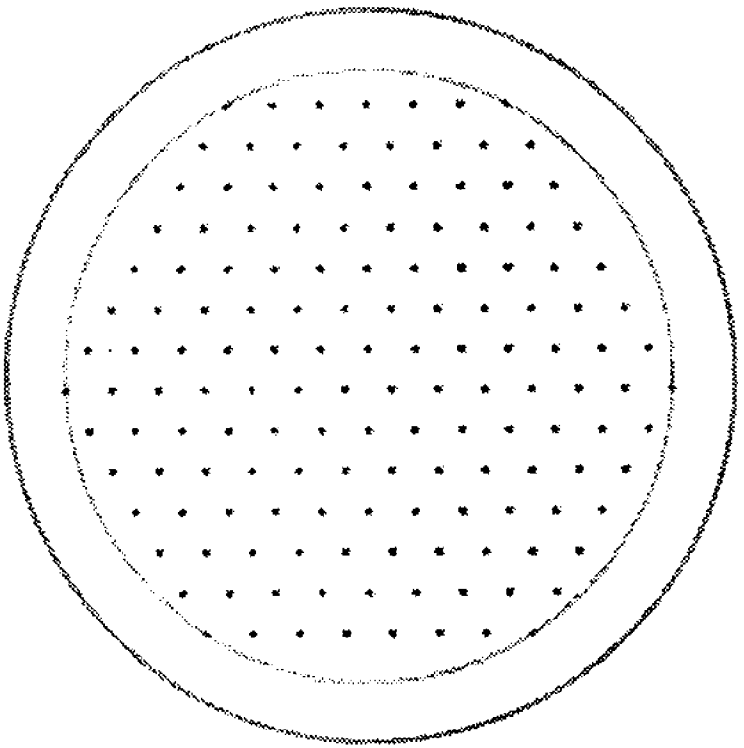
FIGS. 12A, 12B show an exemplary layout of radiating elements in an antenna array.
Figure 12B:
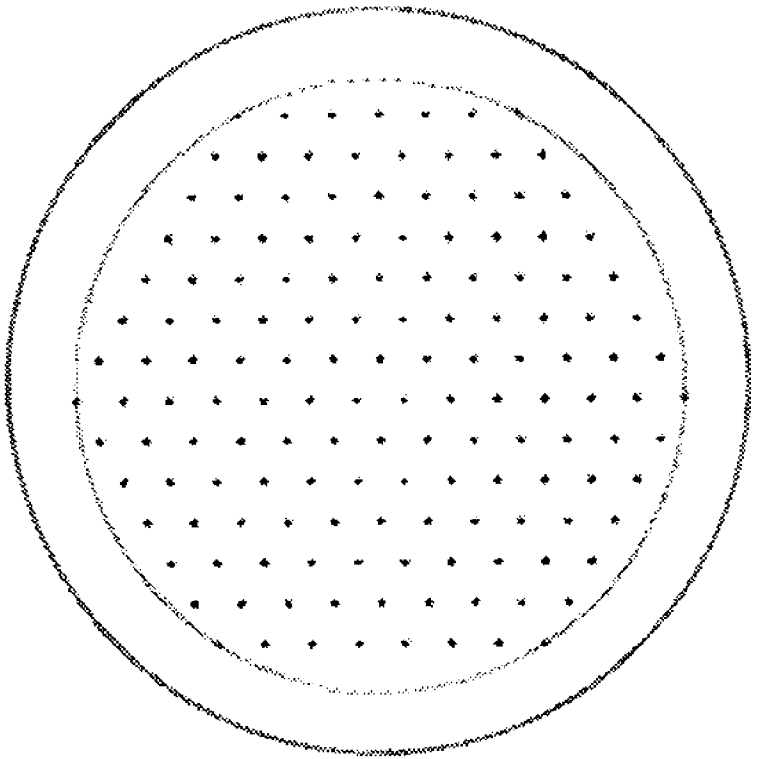

For illustration purposes, FIGS. 12A and 12B shows the layout of radiating elements of an antenna array. In an exemplary embodiment, the antenna array comprises 100 or more radiating elements. However, any suitable number of radiating elements may be used. The selection of the grid position and spacing between elements substantially determines the position of the grating lobes within the bandwidth of operation and scanning range of the antenna array. In one embodiment illustrated by FIG. 12A, the layout of radiating elements has a center radiating element and the overall layout has six-way symmetry. In a second embodiment illustrated by FIG. 12B, the layout of radiating elements does not have a center radiating element, resulting in only a three-way symmetry. Furthermore, in an exemplary embodiment, the center-to-center spacing between the radiating elements is related to the signal wavelength. In one exemplary embodiment, the center-to-center distance between radiating elements is approximately 0.6 wavelengths ($\lambda$) or less. In a second exemplary embodiment, the center-to-center distance between radiating elements is in the range of approximately 0.4 to 0.8 wavelengths ($\lambda$).

Figure 13:
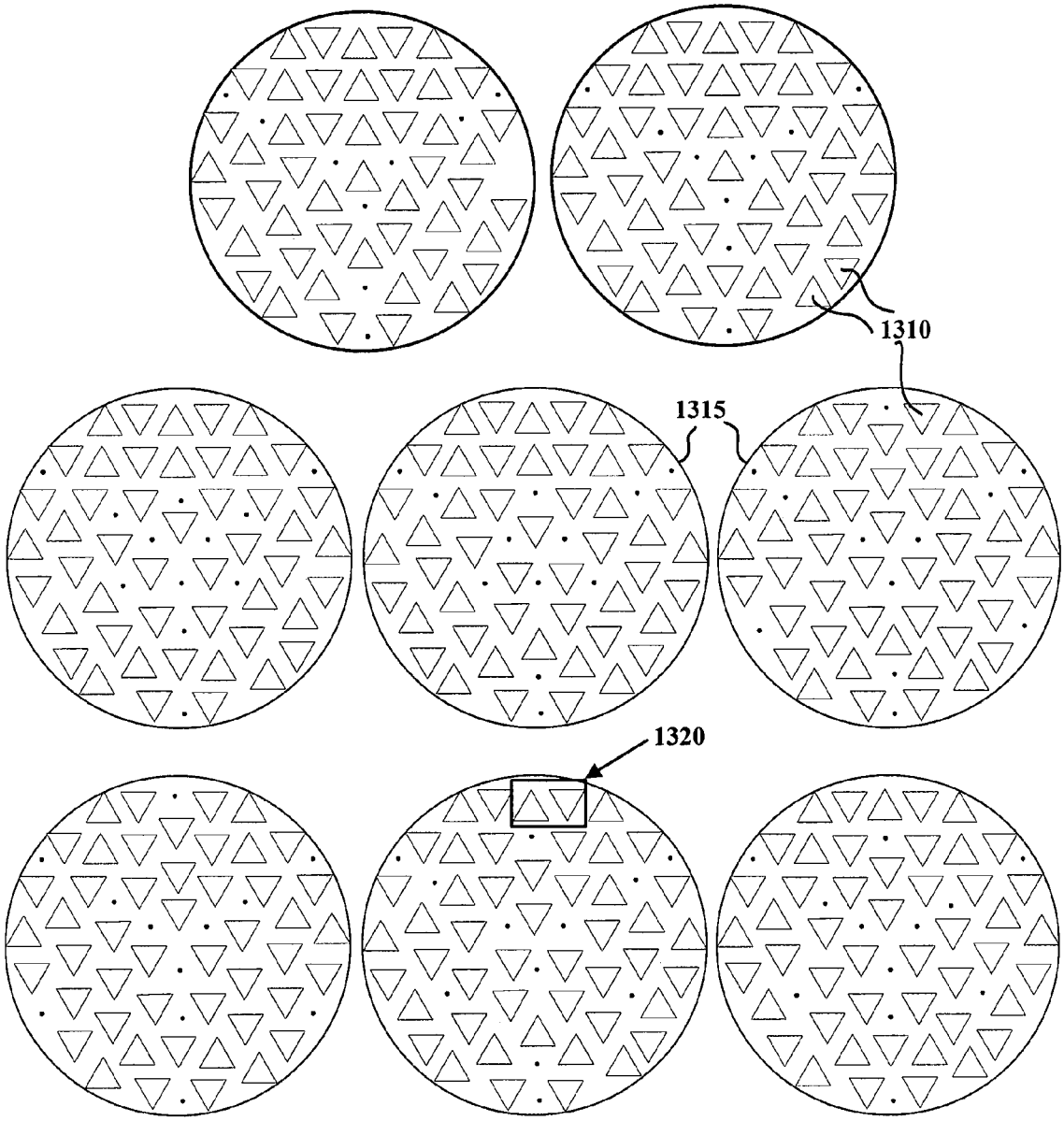
FIG. 13 shows exemplary arrangements of groups of radiating elements in an antenna array.

In an exemplary embodiment and with reference to FIG. 13, various arrangements of three element groups 1310 are possible in the same antenna array layout. In an exemplary embodiment, an antenna array contains only a whole number of element groups. The remaining radiating elements 1315 not part of a group are removed from the antenna array and/or not activated. By not having ungrouped radiating elements, the improved polarization tracking properties are maintained. In another embodiment, an ungrouped radiating element 1315 is excited on its own, which may degrade the polarization tracking properties but increases the antenna array's efficiency, sidelobe level, and directivity. Furthermore, element groups 1310 may be arranged so that multiple groups 1320 are more compact.

In accordance with an exemplary embodiment, rotation of elements in the group improves the symmetry of the polarization pattern and reduces the polarization errors of the group. Rotating elements within a sub-array creates more polarization states in the group compared to an individual element. In one exemplary method, the individual elements are rotated while still maintaining an even distribution and the radiating elements do not overlap with each other. In one embodiment, the radiating elements of different polarization orientation are located in proximity to each other, so that the groups are symmetric and as small as possible given the constraints of the grid.

In an exemplary embodiment, each radiating element of a group has a different physical polarization state, determined by the orthogonal slots of the radiating element. As discussed above, each radiating element is capable of multiple polarization states through electronic polarization tracking. The number of polarization states and the angle between the multiple polarization states is dependent on number of bits (b) in a phase shifter of the radiating element and the number of possible polarization states ($2^b$). In another embodiment, at least one radiating element of a group has a different polarization state than the rest of the group. One skilled in the art can appreciate that any number of radiating elements in a group may be rotated.

In accordance with an exemplary embodiment, the polarization quantization error of an antenna array is reduced by using multiple radiating elements with slightly different polarization states. This difference in polarization states is introduced by rotating the radiating elements of a group relative to the other radiating elements. In an exemplary embodiment, the polarization quantization error is reduced to less than half of a polarization quantization step size. A polarization quantization step size is the same as the angular separation of the polarization states.

In the prior art, typically all the elements in a sub-array are generally arranged such that their polarization orientations are aligned in the same direction. For example, in a linear array, the horizontal and vertical slots in one radiating element would be similarly oriented as the others in that sub-array. In contrast, in an exemplary embodiment and with reference to FIG. 14, radiating elements may be laid out in a manner so that certain radiating elements have a different polarization than other radiating elements In an exemplary embodiment, each of the M radiating elements is laid out (relative to the other radiating elements in the group) such that each element has a slightly different polarization state. Thus, for example, in FIG. 14A, a group 1402 of three radiating elements 1401 are all located around a common point 1403. This forms a desirable triangle pattern with common point 1403 in the middle of the triangle. In one exemplary embodiment, each radiating element is oriented with the horizontal and vertical slots respectively perpendicular and co-linear with radiating lines from the common point 1403. Stated another way, each radiating element 1401 is oriented 120 degrees from the other radiating elements in the group and in a circle about a common point.

For purposes of discussion, each radiating element 1401 has a polarization orientation which is defined relative to the orthogonal slots in the ground plane. In an exemplary embodiment, radiating elements 1401 are rotated so that the polarization orientations of radiating elements 1401 are projected through common point 1403. In another exemplary embodiment, radiating elements 1401 are rotated so that the polarization orientations of radiating elements 1401 have different angles relative to each other and relative to an absolute frame of reference associated with the whole array.

Starting with this arrangement of the radiating elements 1401 in a polarization control group, designing the layout of the radiating elements may include rotating the group as a whole and/or rotating individual radiating elements within the group(s).

Figure 14A:
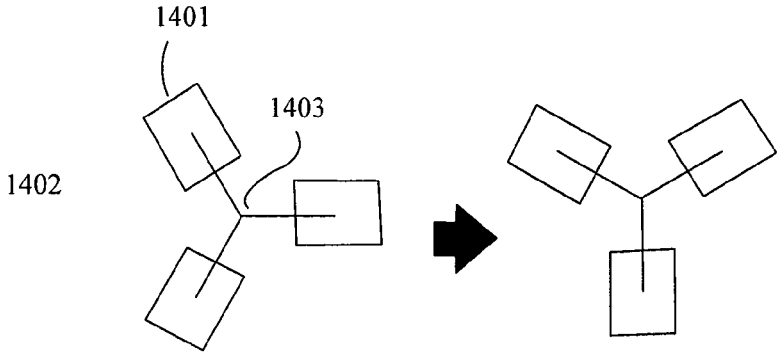
FIGS. 14A, 14B, 14C show exemplary variations of rotated radiating elements in a group.

In an exemplary embodiment and with reference to FIG. 14A, in designing the layout of radiating elements in an antenna, a group 1402 of radiating elements may be rotated as a whole relative to at least one other group in the antenna array. This rotation may be selected, for example, such that adjacent groups 1402, in an antenna, may have different polarization orientations or such that the group fits in the array grid. For example, in the exemplary embodiment with three elements separated by 120 degrees, the groups may be rotated by a multiple of 120, for example 120 or 240 degrees, to maintain the regularity of the grid.

Figure 14B:
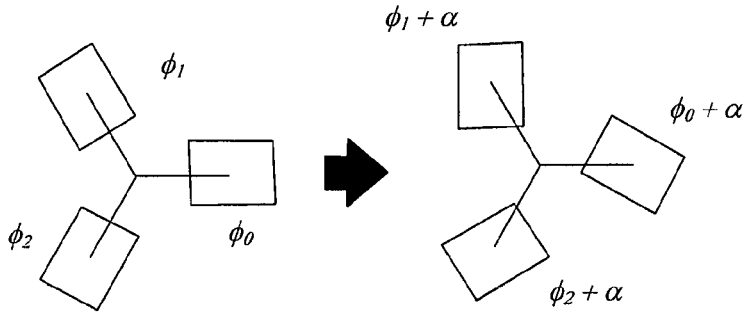

In another embodiment and with reference to FIG. 14B, the group may be replicated from one group to the next, without rotation of the group as a whole. But the individual radiating elements 1401 may be individually rotated from a starting angle $\acute{O}_0$, $\acute{O}_1$, $\acute{O}_2$ to new angle $\acute{O}_0+\alpha$, $\acute{O}_1+\alpha$, $\acute{O}_2+\alpha$ for all radiating elements 1401 in group 1402. The angle $\alpha$ may be added from one group to the next. In another embodiment, the angle $\alpha$ varies from one group to the next. In yet another exemplary embodiment, angle $\alpha$ is configured to meet layout constraints. For example, radiating elements 1401 may be designed with an angle $\alpha$ of about 50 degrees or about 250 degrees. Moreover, in an exemplary embodiment angle $\alpha$ is any suitable angle.

Figure 14C:
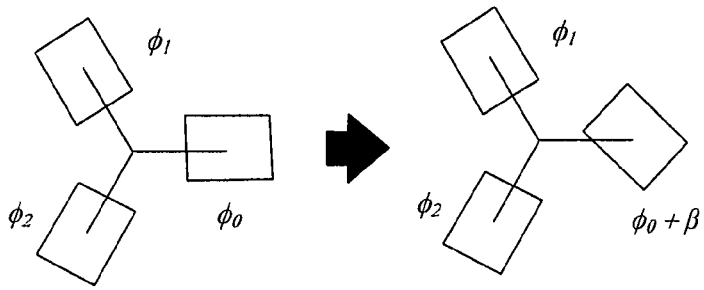

In yet another embodiment and with reference to FIG. 14C, less than all radiating elements 1401 of group 1402 are angled an additional value β, where β is a multiple of $\pi/2^b$. Since this step corresponds to the difference between two polarization states, the polarization quantization error of the rotated element is not modified by this rotation.

Figure 15B:
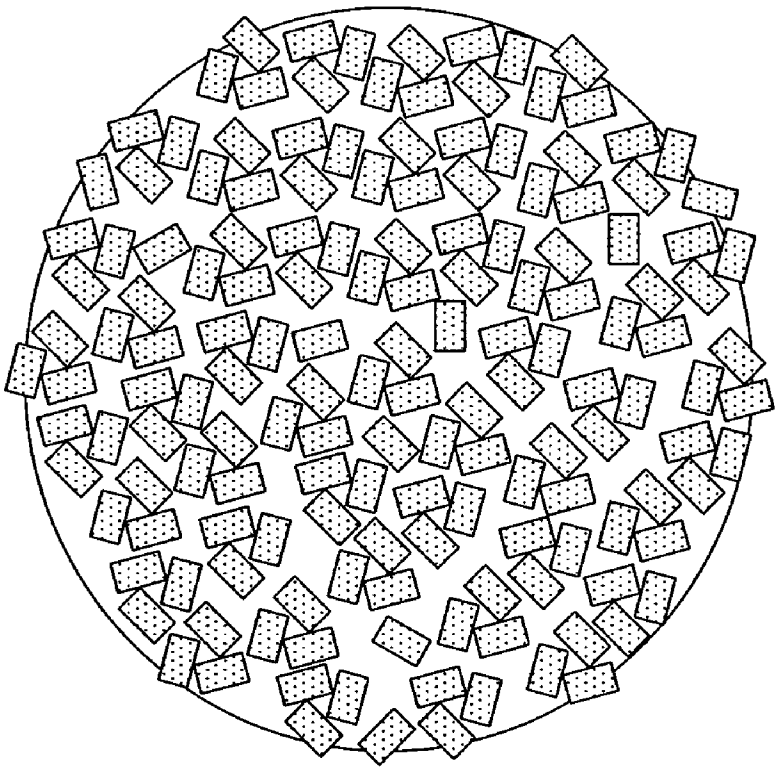
FIGS. 15A, 15B show arrangements of groups of radiating elements in accordance with exemplary embodiments.
Figure 15A:
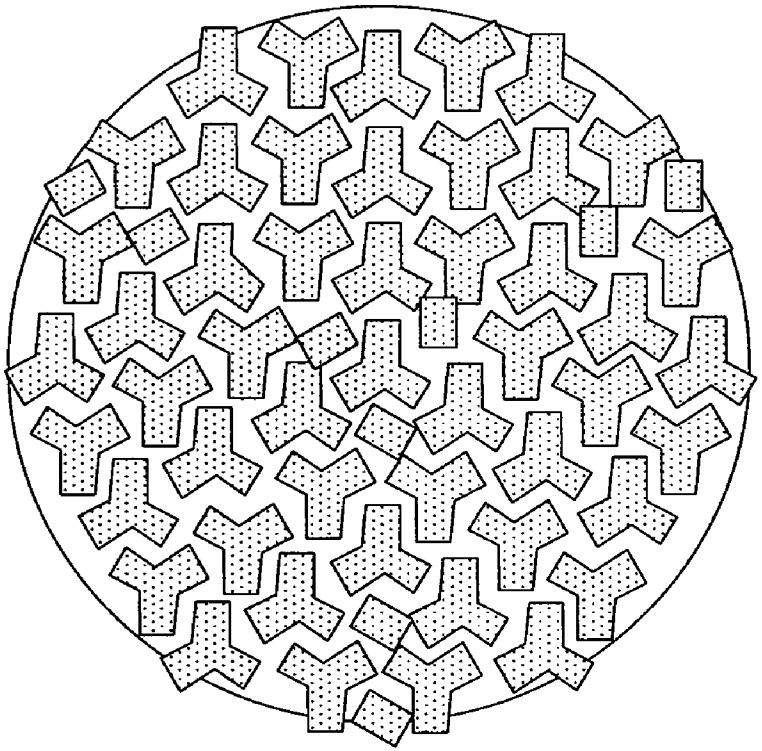

FIG. 15A illustrates a typical embodiment of an arrangement of groups having overlapping radiating elements. FIG. 15B illustrates an exemplary embodiment of an arrangement of groups after varying alpha separately for each group of radiating elements to avoid overlap of elements within the group and also with elements in other groups. By varying alpha separately, the radiating elements may be configured such that the electrical components associated with the radiating elements are designed in a single layer.

Another manner of illustrating the introduction of different polarization states of radiating elements is from the viewpoint of an individual radiating element. Once again each radiating element has a polarization orientation, and a prior art sub-array would arrange all the radiating elements so that the polarization orientations are aligned. In an exemplary embodiment, a radiating element is rotated, thereby introducing a different polarization state compared to the original alignment. To provide improved polarization control, a radiating element is rotated relative to other nearby radiating elements (and each radiating element having a different polarization state). Furthermore, in an exemplary embodiment, an optimal manner of quantization error compensation is achieved by evenly distributing the polarization states of the radiation elements around a circle of possible polarization states. For example, a radiating element with four possible polarization states is configured such that the polarization states are each separated by 90 degrees.

Figure 16:
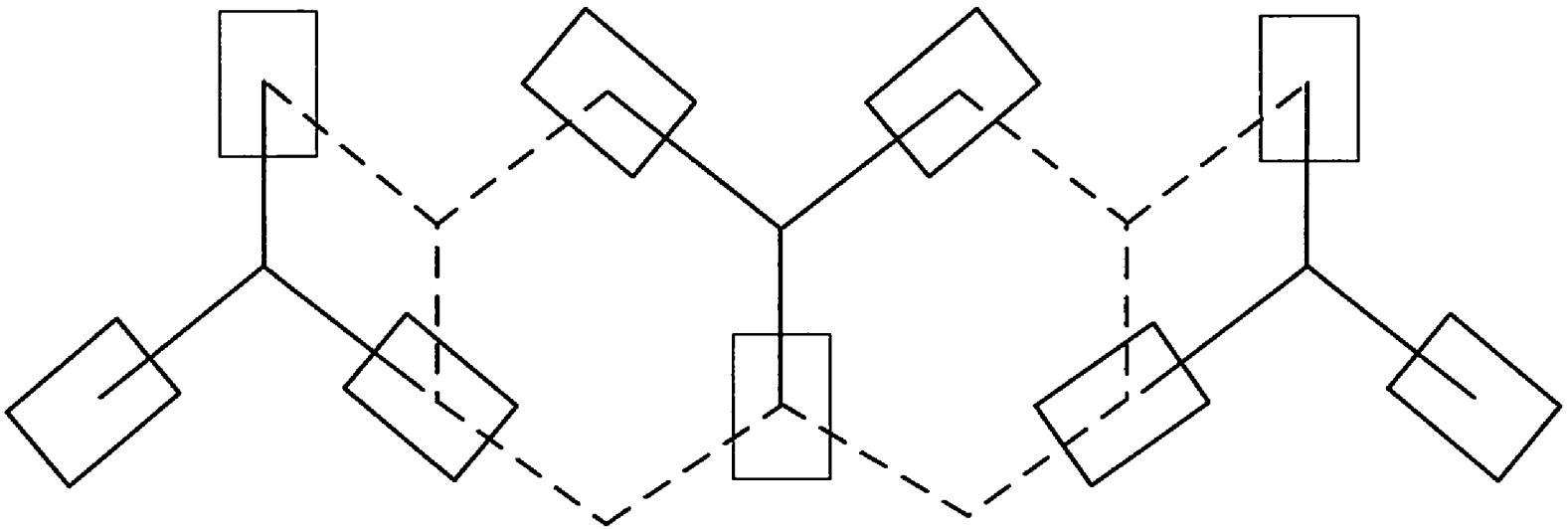
FIG. 16 shows an exemplary embodiment of a sequential rotation of a plurality of groups.

In accordance with an exemplary embodiment and with reference to FIG. 16, a group of radiating elements is sequentially rotated. In this exemplary embodiment, the group may, for example, be laid out in a linear fashion with a rotation of the group from one group to the next. In one example, each successive group of radiating elements in a line of groups, is rotated 60 degrees more than the predecessor. Any suitable angle of rotation may be used, recognizing that rotations of 90 degrees and 180 degrees are repetitive. The sequential rotation of a group of radiating elements may be designed to achieve a combination of benefits, including improvement of crosspolarization, input matching, polarization isolation, and pattern symmetry. In an exemplary embodiment, these benefits are achieved in addition to compensation of the polarization quantization error.

Figure 17:
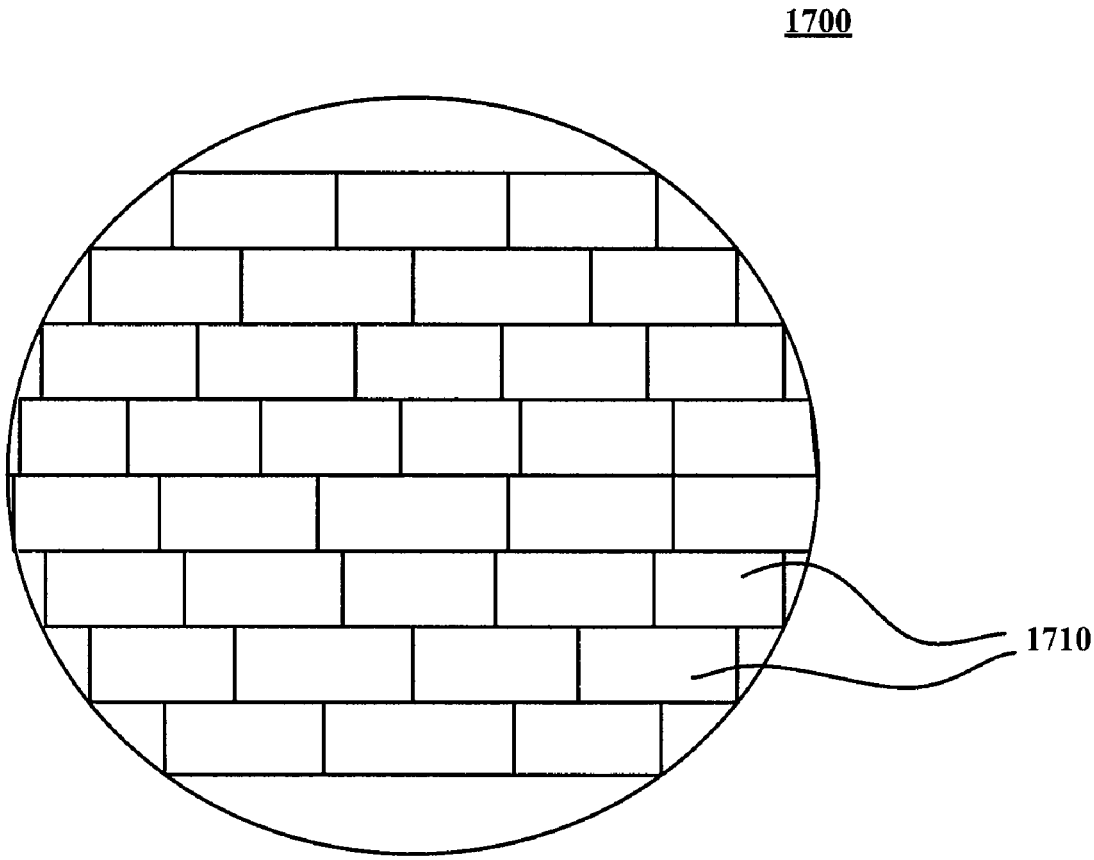
FIG. 17 shows an illustration of an antenna that comprises multiple sub-arrays.

In accordance with an exemplary embodiment and with reference to FIG. 17 for illustration, an exemplary antenna 1700 comprises multiple sub-arrays 1710. In one embodiment, a single type of sub-array 1710 is used to form the entire antenna. In other words, antenna 1700 is assembled using multiple sub-arrays 1710 where all the sub-arrays have the same dimensions. This is beneficial in manufacturing mass-produced antennas using common components regardless of the specifications for the particular antenna. In other exemplary embodiments several types of sub-arrays are used to form a single antenna. Although producing a number of different parts has some manufacturing draw backs, it should be appreciated that use of smaller sub-arrays and/or a combination of larger and smaller sub-arrays facilitates filling out the edges of an antenna array. The use of a combination of modular sub-arrays facilitates customization or semi-customization of antenna arrays.

In accordance with one method of building an antenna, a standard sub-array is used repetitively as a building block in forming the phased array of receiving elements. The groups and rotation principles discussed herein may be applied within a single sub-array, or across multiple sub-arrays once combined. For example, in a single sub-array example, a triangular pattern group of elements may be rotated compared to its neighbor groups in a sub-array. In another example, the pattern of elements or groups of elements may include the adjacent sub-arrays such that similar principles apply without interruption due to the boundary between adjacent sub-arrays. In one example, the sub-arrays are staggered such that a triangle pattern (as discussed above) is formed when the two sub-arrays are brought together.

The phased array antenna structure can be manufactured using a single pressing due to this arrangement. The advantages of a single pressing include 1) simpler vertical structure, with fewer types of vertical interconnections, which facilitates design; 2) cheaper fabrication; and 3) lower profile. Furthermore, in an exemplary embodiment, the phased array antenna structure has a profile of 6 mm or less. In another embodiment, the phased array antenna structure has a profile of 15 mm or less In the exemplary embodiment, electrical components comprising feed lines, control lines, and associated circuitry are designed on the back side of a substrate such that the substrate is manufactured using a single pressing. In an exemplary embodiment, the feeding network consists of a single, internal layer.

Figure 18:
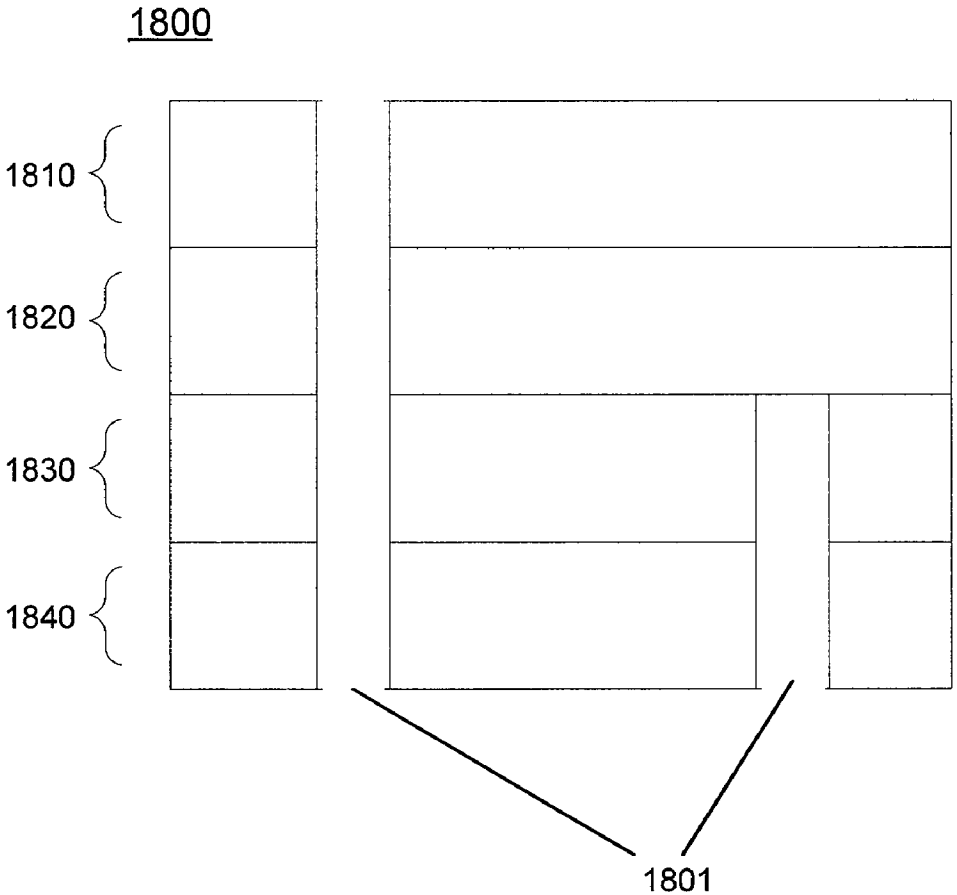
FIG. 18 shows a sectional view of an exemplary monolithic printed circuit board.

In accordance with an exemplary embodiment and with reference to FIG. 18, a monolithic printed circuit board 1800 comprises a first external layer 1810 with an upward facing radiating element, a first internal layer 1820 with an RF distribution network, a second internal layer 1830 facilitating distribution of power and control lines, and a second external layer 1840 with electronic control circuitry. In an exemplary embodiment, first internal layer 1820 only connects with first external layer 1810, and second internal layer 1830 only connects with second external layer 1840. In an exemplary embodiment, this configuration includes vertical connections 1801 but has no internal vertical interconnections, allowing monolithic printed circuit board 1800 to be fabricated using a single press process. In another exemplary embodiment, micro-vias are implemented in monolithic printed circuit board 1800. Additionally, the different materials may be used to manufacture each of the layers 1810-1840. Moreover, in an exemplary embodiment, monolithic printed circuit board 1800 is applied in a phased array architecture as described herein.

In accordance with an exemplary embodiment, monolithic printed circuit board 1800 does not use extra internal layers because components such as radiating elements are arranged on the same layout without overlapping. However, the performance of an exemplary antenna system is not decreased due to the implementation of the systems and methods disclosed herein.

In an exemplary embodiment, an antenna sub-array, with an associated polarization quantization error, comprises a first radiating element configured with a first polarization orientation; and a second radiating element configured with a second polarization orientation. Furthermore, the first radiating element and the second radiating element are configured to reduce the polarization quantization error to be less than half of a polarization quantization step size.

Benefits, other advantages, and solutions to problems have been described above with regard to specific embodiments. However, the benefits, advantages, solutions to problems, and any element(s) that may cause any benefit, advantage, or solution to occur or become more pronounced are not to be construed as critical, required, or essential features or elements of any or all the claims. As used herein, the terms "includes," "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. Further, no element described herein is required for the practice of the invention unless expressly described as "essential" or "critical."

What is claimed is:

1. An antenna subarray with an associated polarization quantization error, the antenna subarray comprising:

a first radiating element configured with a first physical polarization orientation; and a second radiating element configured with a second physical polarization orientation;

a third radiating element configured with a third physical polarization orientation;

wherein each of said first radiating element, said second radiating element, and said third radiating element have electronic polarization control;

wherein each of said first radiating element, said second radiating element, and said third radiating element are dual polarized;

wherein said first physical polarization orientation is different than at least one of said second physical polarization orientation or said third physical polarization orientation;

wherein said first radiating element, said second radiating element, and said third radiating element are configured to reduce the polarization quantization error to be less than half of a polarization quantization step size; and wherein said first radiating element, said second radiating element, and said third radiating element are evenly distributed about a common point.

2. The antenna subarray of claim 1, wherein said first radiating element is rotated relative to said second radiating element such that said first physical polarization orientation is different than said second physical polarization orientation.

3. The antenna subarray of claim 1, wherein said first radiating element implements a phase delay such that said first polarization orientation is different than said second polarization orientation.

4. The antenna subarray of claim 1, wherein the polarization quantization error is reduced using at least one of a phase delay and rotation of said first radiating element relative to at least one of said second radiating element or said third radiating element.

5. The antenna subarray of claim 1, wherein said first polarization orientation is complementary to said second polarization orientation.

6. The antenna subarray of claim 1, wherein at least one of said first radiating element or said second radiating element further comprise at least one phase shifter configured for a dedicated function, and wherein the dedicated function is either beam steering or polarization control.

7. The antenna subarray of claim 6, wherein at least one of said first radiating element or said second radiating element further comprise an unbalanced phase shifter arrangement.

8. The antenna subarray of claim 6, wherein at least one of said first radiating element or said second radiating element further comprise a balanced phase shifter arrangement.

9. The antenna subarray of claim 1, wherein at least one of said first radiating element or said second radiating element further comprise at least one combined phase shifter configured to facilitate beam steering and polarization control.

10. The antenna subarray of claim 9, wherein at least one of said first radiating element or said second radiating element further comprise a balanced phase shifter arrangement.

11. The antenna subarray of claim 1, wherein said first radiating element, said second radiating element, and said third radiating element are all sequentially rotated relative to each other.

12. The antenna subarray of claim 1, wherein said antenna subarray is configured as a modular component in an antenna.

13. A radiating element group in an antenna configured to reduce a quantization error associated with an antenna, said radiating element group comprising:

at least three dual polarized radiating elements each comprising a ground plane with substantially orthogonal slots;

wherein said radiating element group is configured with electronic polarization control of the at least three radiating elements;

wherein said radiating element group comprises a common point about which said at least three radiating elements are distributed;

wherein each of said at least three dual polarized radiating elements comprises a physical polarization orientation defined by the orientation of the respective orthogonal slots that is different than the physical polarization orientation of at least one other radiating element of said radiating element group; and wherein said at least three radiating elements are evenly distributed about said common point.

14. The radiating element group of claim 13, wherein said at least three dual polarized radiating elements are unidirectional.

15. The radiating element group of claim 13, wherein the same polarization of the physical polarization orientation of each of said at least three radiating elements is aligned towards the common point.

16. The radiating element group of claim 13, wherein the same polarization of the physical polarization orientation of each of said at least three radiating elements is aligned towards the common point and further rotated a common angle about each of said at least three radiating elements.

17. The radiating element group of claim 13, wherein said at least three radiating elements further comprises at least one phase shifter having 'b' bits, and wherein the same polarization of the physical polarization orientation of each of said at least three radiating elements is aligned towards the common point and one of said at least three radiating elements is further rotated an additional value $\beta$, where $\beta$ is a multiple of $\pi/2^b$.

18. The radiating element group of claim 13, wherein said at least three radiating elements are spaced less than 0.6 wavelengths of a received signal from each other.

19. A method of reducing quantization error in an antenna, wherein said antenna comprises radiating elements, said method comprising:

arranging a plurality of dual polarized radiating elements in a group, wherein said plurality of dual polarized radiating elements are evenly distributed about a common point, wherein each of said plurality of dual polarized radiating elements comprises a ground plane with substantially orthogonal slots and each of said plurality of dual polarized radiating elements is associated with an initial physical polarization orientation defined by said orthogonal slots, and wherein said radiating element group is configured with electronic polarization control of the at least three radiating elements;

wherein said plurality of dual polarized radiating elements are rotated such that at least one of said plurality of dual polarized radiating elements has a different physical polarization orientation than at least one other of said plurality of dual polarized radiating elements;

communicating a signal through said antenna; and reducing the polarization quantization error of said antenna to less than half of a polarization quantization step size.

20. The method of claim 19, further comprising:

receiving the signal at said plurality of dual polarized radiating elements;

communicating, at each of said plurality of dual polarized radiating elements, the signal through a combined phaseshifter, wherein said combined phaseshifter is configured to facilitate polarization control and beam steering;

combining the signal from each of said plurality of dual polarized radiating elements, wherein at least one signal from said plurality of dual polarized radiating elements has a different polarization than at least one other signal from said plurality of dual polarized radiating elements.

21. The method of claim 19, further comprising rotating said group of plurality of dual polarized radiating element relative to another group of radiating elements.

* * * * *